US005573388A

United States Patent [19]

Tar et al.

[11] Patent Number: 5,573,388

[45] Date of Patent: Nov. 12, 1996

[54] ECCENTRIC PUMP WITH LOCK VALVE AND WITH BIDIRECTIONAL ROTATIONAL OPERATION

[75] Inventors: Lóránt Tar; László Légmán; Iibor Végh, all of Györ, all of Hungary

[73] Assignee: Raba Magyar Vagon-es Gepgyar Rt., Gyor, Hungary

[21] Appl. No.: 393,263

[22] Filed: Feb. 23, 1995

[30] Foreign Application Priority Data

Feb. 24, 1994 [HU] Hungary ..... P9400537

[51] Int. Cl.[6] ..... F04C 2/04; F04C 15/04

[52] U.S. Cl. ..... 418/15; 418/32; 418/64

[58] Field of Search ..... 418/15, 32, 64; 417/315

[56] References Cited

U.S. PATENT DOCUMENTS

| | | | |
|---|---|---|---|
| 1,035,449 | 8/1912 | Kinney | 418/32 |
| 2,102,344 | 12/1937 | Wishart | 418/32 |
| 3,039,677 | 6/1962 | Nissley | 418/32 |
| 3,985,473 | 10/1976 | King et al. | 418/32 |

*Primary Examiner*—John J. Vrablik
*Attorney, Agent, or Firm*—Young & Thompson

[57] ABSTRACT

An eccentric pump with lock valve and with bidirectional rotational operation, mainly for lubricant circulation of drives comprises a stationary outer casing having two parallel side walls and a cylindrical inner surface between the side walls, and further having inlet and outlet openings being sealingly separated and terminating in the cylindrical inner surface, a middle shaft arranged within the casing concentrically to the cylindrical inner surface and having a cylindrical surface being eccentric to the middle shaft as well as to the cylindrical inner surface of the casing, a circular sealing ring being sealingly displaceable in respect of the eccentric surface of the shaft as well as to inner wall portions of the casing, and further having a radial slot sealingly engaging a stationary pin with its both limiting surfaces. The improvement achieved by this invention is that an inner slide member is arranged between the casing and the circular sealing ring, the slide member being sealingly but moveably attached to inner surfaces of the casing, and the slide member being rotatable between a first position and a second position, and the casing has two inlet openings and at least one outlet opening, and the slide member has two through bores, the first through bore is in communication with one inlet opening, the second through bore with at least one outlet opening, in the first position of the slide member, and the first through bore is in communication with at least one outlet opening, the second through bore with the other inlet opening, in the second position of the slide member, and the pin is fixed to the slide member and is sealingly separating the through bores from each other. Therefore, the eccentric pump can be mounted directly on the force transmitting shaft of the drive and the shaft can rotate in both directions without stopping the liquid discharge.

7 Claims, 4 Drawing Sheets

ECCENTRIC PUMP WITH LOCK VALVE AND WITH BIDIRECTIONAL ROTATIONAL OPERATION

BACKGROUND OF THE INVENTION

1. Field of the Invention

The invention relates to an eccentric pump with lock valve which can operate with both directions of its rotational drive, as with lubricant circulation of drives often the case is. The eccentric pump comprises:

a stationary outer casing having two parallel side walls and a cylindrical inner surface between the side walls, and further having inlet and outlet openings being sealingly separated and terminating in the cylindrical inner surface, a shaft arranged within the casing concentrically to the cylindrical inner surface and having a cylindrical surface being eccentric to the shaft as well as to the cylindrical inner surface of the casing, a circular sealing ring being sealingly displaceable in respect of the eccentric surface of the shaft as well as to inner wall portions of the casing, and further having a radial slot sealingly engaging a stationary pin with its both limiting surfaces.

2. Description of the Related Art

In the prior art, eccentric pumps with lock valve (as described in detail in e.g. U.S. Pat. No. 4,737,089) have been proposed to eliminate the drawbacks of the conventional pumps such as gear pump, screw pump, rotary pump, etc. These units are quite complex assemblies containing twenty to thirty pans, they are quite voluminous, they cannot be mounted on the shaft of a drive directly but they need a free shaft end and/or separate power transmission unit such as gears or chain. Further, they are sensible to failures and frequent control and replacement are necessary with them. The eccentric pump proposed earlier is, in contrast, a simple construction with easily producible minimal number of pans, and it can directly be mounted on the shaft of the drive with a reduced space requirement.

In the eccentric pump, the space between the pump casing and the eccentric rotary pan is divided during rotation by the contact point of the casing and the rotary part and by the lock valve into an expanding suction chamber and a reducing pressure chamber while the contact point moves from the suction inlet of the pump towards its pressure outlet. With this, liquid is sucked into the suction chamber and discharged from the pressure chamber.

The practice has shown, however, that the conventional eccentric pumps are not suitable in applications, wherein the direction of rotation to be used for driving the pump can be reversed during operation. As it will be clear from what have been said above, the eccentric pump will not forward liquid any more if the driving shaft rotates in the reverse direction. The more, it will suck away the liquid which have been transported by the eccentric pump earlier, during the operational rotation. This feature simply excludes eccentric pumps from using them with drives wherein the operation of the drive in reverse rotational direction often occurs. In reverse rotation, the load on the drives is often greater than normally, therefore, the drive cannot remain without any lubricant and cooling medium. In the prior art, it is not known to use eccentric pumps in applications wherein bidirectional rotational operation can occur.

SUMMARY OF THE INVENTION

The main objective of the present invention is to provide an eccentric pump with lock valve which fully satisfies the above mentioned need to allow both rotational directions for the pump as well as direct mounting on the force transmitting shaft of a drive and which, however, preserves all benefits of the previous arrangements.

Hence, according to the invention, an eccentric pump with lock valve comprises a stationary outer casing having two parallel side walls and a cylindrical inner surface between the side walls, and further having inlet and outlet openings being sealingly separated and terminating in the cylindrical inner surface, a shaft arranged within the casing concentrically to the cylindrical inner surface and having a cylindrical surface being eccentric to the shaft as well as to the cylindrical inner surface of the casing, a circular sealing ring being sealingly displaceable in respect of the eccentric surface of the shaft as well as to inner wall portions of the casing, and further having a radial slot sealingly engaging a stationary pin with its both limiting surfaces.

The improvement is in that an inner slide member is arranged between the casing and the circular sealing ring, the slide member being sealingly but moveably attached to inner surfaces of the casing, and the slide member being rotatable between a first position and a second position, and the casing has two inlet openings and at least one outlet opening, and the slide member has two through bores, the first through bore is in communication with one inlet opening, the second through bore with at least one outlet opening, in the first position of the slide member, and the first through bore is in communication with at least one outlet opening, the second through bore with the other inlet opening, in the second position of the slide member, and the pin is fixed to the slide member and is sealingly separating the through bores from each other.

Various optional or preferred features are set out in the detailed description forming part of this specification.

Thus, in one exemplified embodiment of this invention, the slide member has a flange being perpendicular to its cylindrical surface and sealingly but moveably attached to the inner surface of the side wall of the casing, and the inlet and outlet openings of the casing are formed in this side wall and the through bores are formed in the flange of the slide member.

It is also preferred, according to the invention, that the slide member and the pin are made of one piece.

A further preferred embodiment is a unit in which stopping means are provided in the slide member and the outer casing determining the first and second positions of the slide member. Now, it can be preferable that the stopping means are formed as a pin fixed in the slide member and protruding into an arched slot of the casing, and a length of the slot is equal to a length of the rotational movement of the slide member between its two positions.

It is still another preferred embodiment, wherein the slide member has a cam protruding out from the cylindrical radial surface of the slide member and engaging a recess in the casing and a length of the slot is equal to a length of the rotational movement of the slide member between its two positions.

In still another preferred embodiment, a second outlet opening is provided in the side wall, which is opposite to the side wall containing the first outlet opening.

Finally, it is also preferred that the eccentric surface of the shaft is provided as a groove being eccentric to the shaft and the sealing ring is sealingly and displaceably contained in the groove.

BRIEF DESCRIPTION OF THE DRAWINGS

Embodiments of this invention will now be described by way of example with reference to the accompanying drawings, in which.

DETAILED DESCRIPTION OF THE PREFERRED EMBODIMENTS

Figure 1:
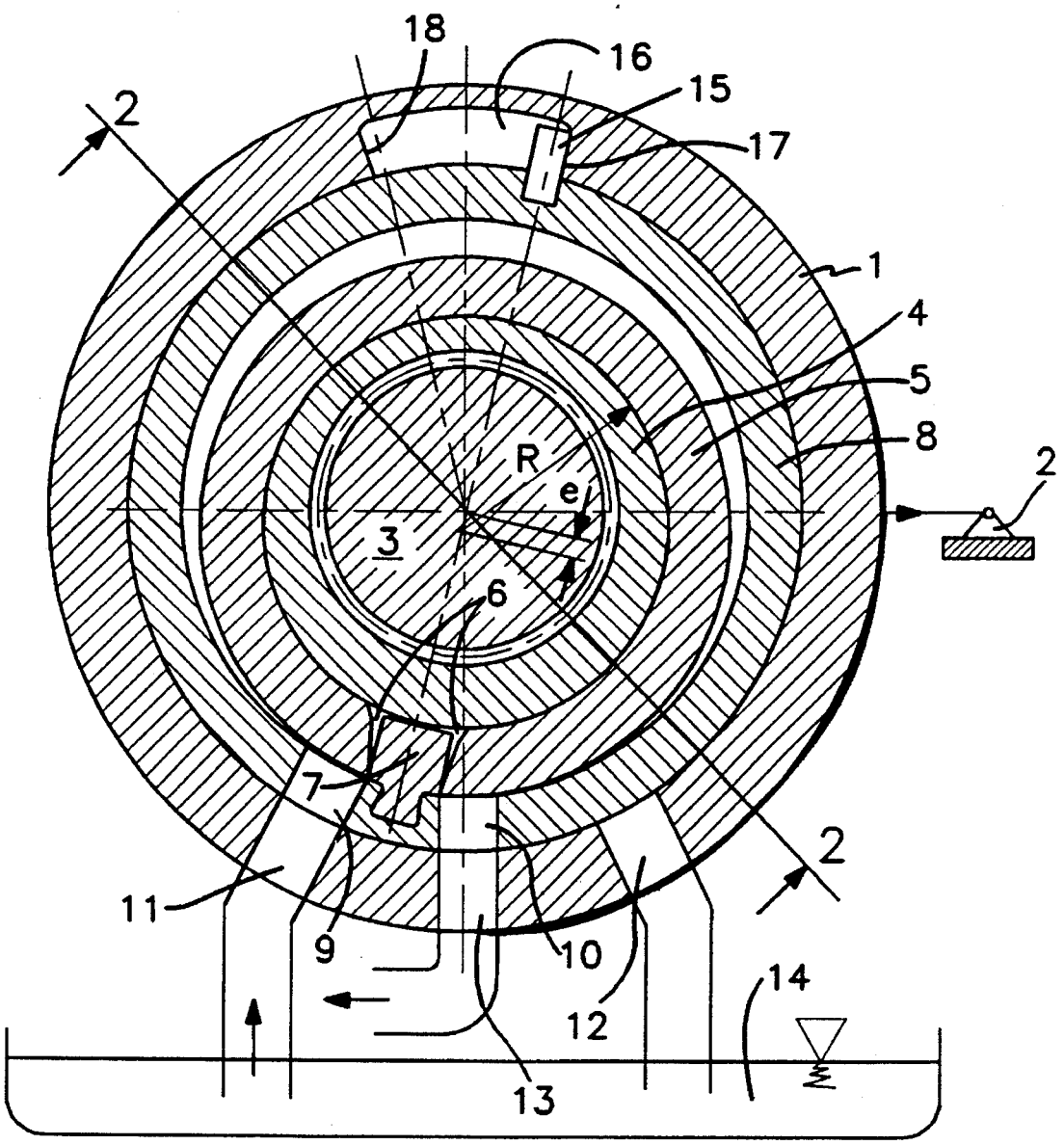
FIG. 1 illustrates a preferred embodiment of the eccentric pump as in this invention in cross sectional view.

The embodiment as shown in FIG. 1. has a casing 1, which, as indicated at 2, is secured against any motion. In the middle of the pump, a rotatably driven shaft 3 is led through onto which, in this embodiment, a cylindrical but eccentric member 4 is connected in a torque transmitting way. The radius of this eccentric member 4 is shown by R and the distance (i.e. the eccentricity) between the middle axis of the shaft 3 and the eccentric member 4 by e.

The eccentric member 4 carries a circular sealing ring 5 which is arranged on the eccentric member 4 in a sealed but relatively displaceable manner. At one point, the sealing ring 5 is cut off and there, a radial slot 6 is provided. Opposite limiting surfaces of the sealing ring 5 forming the slot 6 engage a pin 7. During operation, these limiting surfaces sealingly slide on the surface of the pin 7.

In sense of the invention, an inner slide member 8 is arranged in the inside of the casing 1, between the casing 1 and the sealing ring 5. The slide member 8 is sealed against the inner cylindrical surface of the casing 1 but it can slide on it. Two through bores 9 and 10 are provided in the slide member 8, between which, the pin 7 is fixed.

The outer casing 1 has three openings, a first inlet opening 11, a second inlet opening 12 and an outlet opening 13 between them. The angular distance between the neighbouring opening 11, 13, 12 is the same as between the bores 9 and 10 in the slide member 8. The inlet openings 11, 12 are terminating in a liquid container 14.

The eccentric pump as in this invention has means to determine a limited rotation of the slide member 8. In the embodiment of FIG. 1, this is provided by a pin 15 radially fixed in and protruding out of the slide member 8, and further by an arched slot 16 of the casing 1 receiving the protruding end of the pin 15. When the pin 15 abuts on one limiting surface 17 of the slot 16, a first position of the slide member 8, when it abuts on an opposite limiting surface 18 of the slot 16, a second position of the slide member 8 is defined.

In operation of the embodiment as shown FIG. 1, the shaft 3 rotates in clock-wise direction and it takes with it the eccentric member 4. The sealing ring 5, in turn, is held in its place by the pin 7. During rotation, the point of contact between the sealing ring 5 and the slot 6, which is at the pin 7 in FIG. 1, will move on the inner cylindrical surface of slide member 8 also in clockwise direction. The reaction forces will hold the slide member 8 in this first position, wherein the bore 9 is in conjunction with the first inlet opening 11 and the other bore 10 of the slide member 8 with the outlet opening 13 of the casing 1. During movement of the point of contact towards the bore 10, the space called suction chamber and defined by the point of contact, the slide member 8, the sealing ring 5 and side walls 19, 20 (see FIG. 2) of the casing 1 and communicating with the first inlet opening 11 will continuously grow, and the space called pressure chamber on the other side of the point of contact and communicating with the outlet opening 13 will shrink. With this, liquid will be sucked through the first inlet opening 11 into the pump and liquid will be discharged from it through the outlet opening 13.

If in another operational condition, the rotational direction of the shaft 1 would be changed into counter-clockwise direction, the roles of the suction chamber and the pressure chamber would be interchanged. The reaction forces of the opposite direction, however, would rotate the slide member 8 also in counter-clockwise direction until the pin 15 abuts on the surface 18 of the slot 16 reaching the second position of the slide member 8. In this, the bore 8 would terminate in the outlet opening 13 and the bore 10 in the second inlet opening 12. Thus, the liquid would be sucked through the second inlet opening 12 from the oil container 14 and it would be discharged through the outlet opening 13, in this case, too. In both positions, the inlet opening which is out of function, is closed by the slide member 8, thus, the liquid cannot escape through it.

Figure 2:
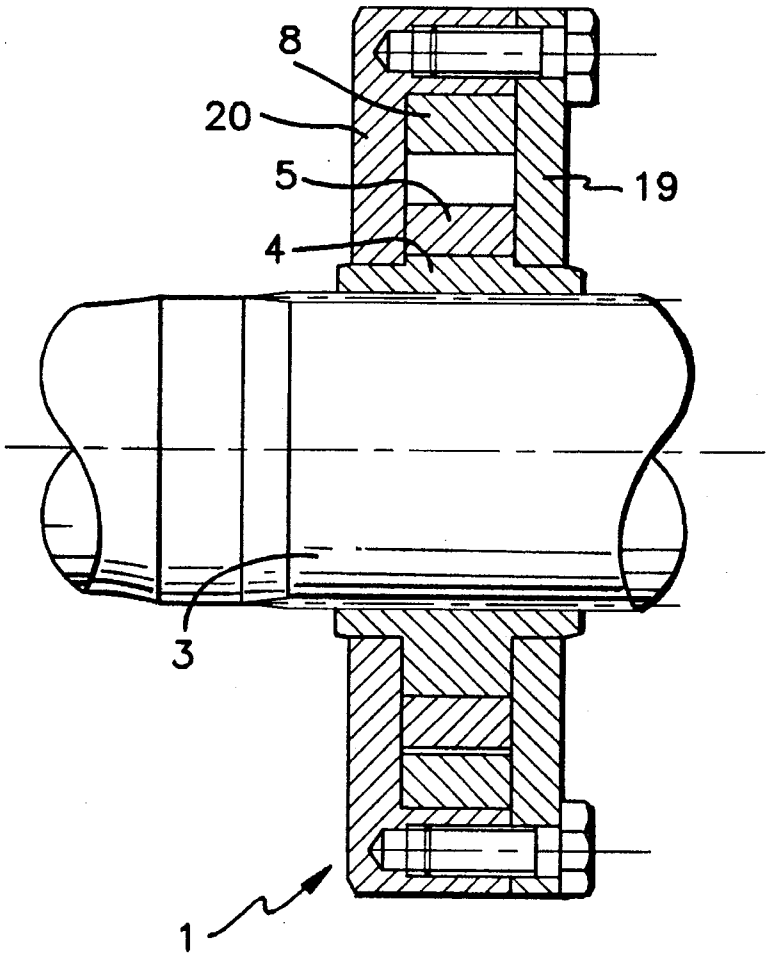
FIG. 2 is a section of the embodiment in FIG. 1, taken along line II—II of FIG. 1.

The arrangement of the parts as mentioned with FIG. 1 will be more apparent from FIG. 2. The role of the side walls 19, 20 in defining the inner liquid chamber of the pump is also illustrated.

Figure 3:
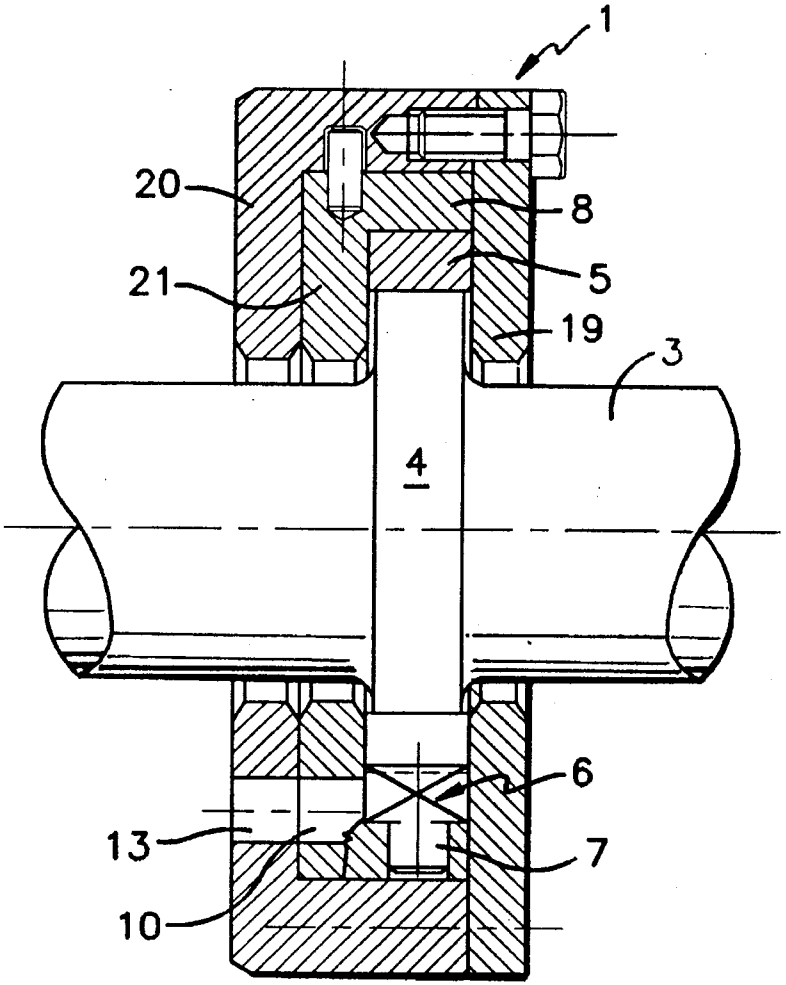
FIG. 3 shows another embodiment in longitudinal cross section.

The embodiment of the eccentric pump as in this invention shown in FIG. 3 differs from that in FIG. 1 by the arrangement of the openings 11 to 13 and by the eccentric member 4. In this unit, the openings 11 to 13 are arranged parallelly to the shaft 3. For this, the slide member 8 has a perpendicular flange portion 21 lying against the wall 20 of the casing 1. The liquid chamber of the pump is now circumferenced by the flange 21, cylindrical portion of the slide member 8, the side wall 19 and the sealing ring 5. The bores 9 (not shown) and 10 are formed in the flange 21 on one diameter, whilst the inlet openings 11, 12 (not shown) and outlet opening 13 in the wall 20 and on the same diameter.

The eccentric member 4 is, in this example, made of one piece with the shaft 3.

Figure 5:
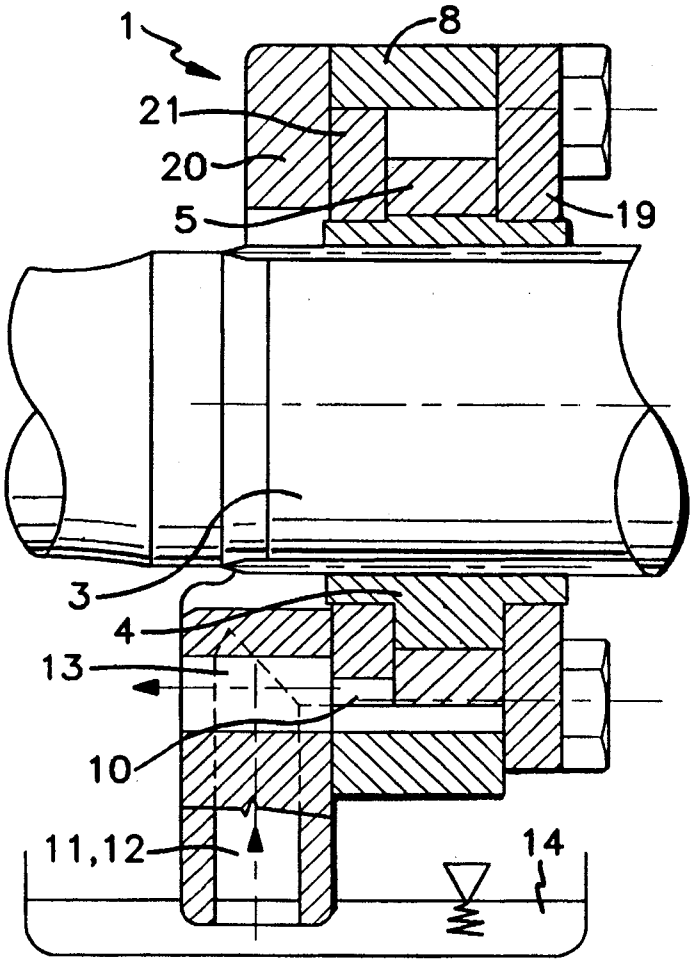
FIG. 5 is a section taken along line V—V of FIG. 4.
Figure 4:
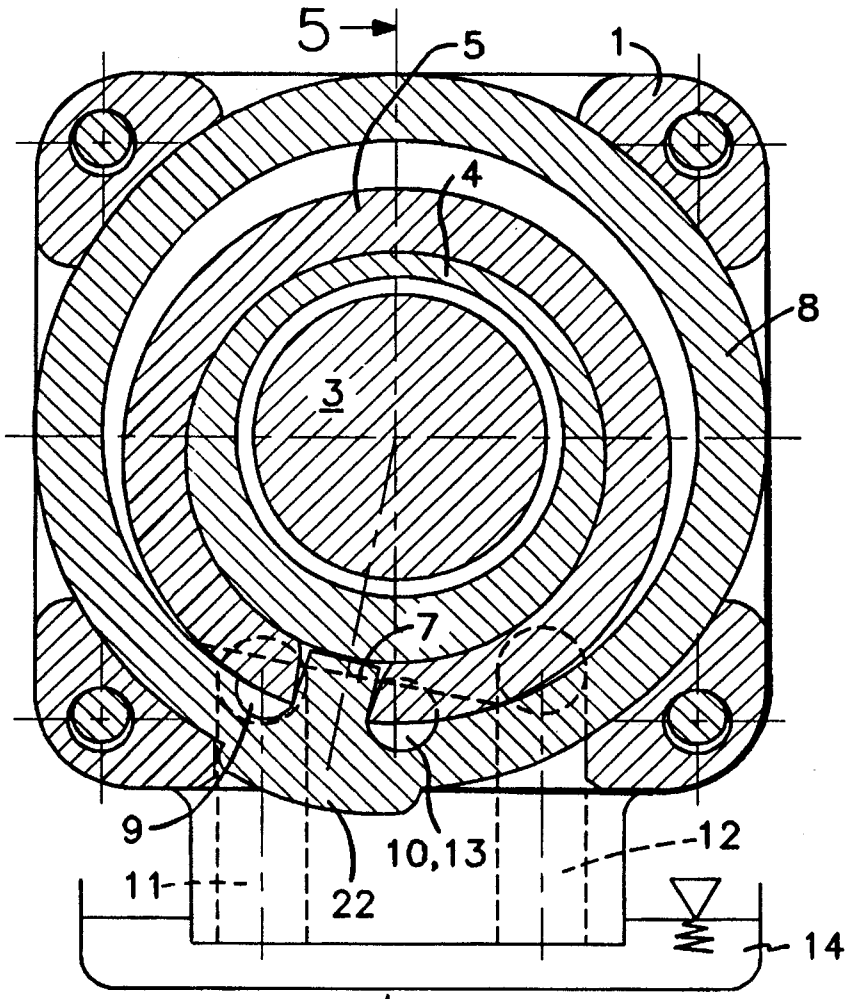
FIG. 4 is a cross section of still another embodiment.

The arrangement of the openings 11 to 13 and the bores 9 and 10 will be more clear from FIGS. 4 and 5. With bore 10, the outlet opening 13 is coaxial (FIG. 5), whilst the inlet openings 11, 12 on both sides of the outlet opening 13 are directed perpendicularly to the outlet opening 13 down into the oil container 14. This unit has a quite secure operation, since the means to determine a limited rotation of the slide member 8 is provided in form of a cam 22 protruding out of the cylindrical outer surface of the slide member 8. The inner cylindrical surface of the casing 1 is interrupted between the corners of the casing 1 providing recesses in the casing 1. One of these recesses is used to receive the cam 22 which will impact on the limiting surfaces 17 and 18 of the recess in the different operational positions of the slide member 8, respectively.

The construction is extremely simplified by having the pin 7 made of one piece with the slide member 8. Thus, in this embodiment, the slide member 8 takes over the role of the rotation limiter, the lock valve (pin 7) and, partially, the casing 1, too.

FIG. 5 shows, that the flange portion 21 is formed as a separate disc which, however moves together with the slide member 8. The bores 9, 10 are provided in this disc. This solution is beneficial with regard to the simple mass production of the slide member 8 and the flange portion 21.

Figure 6:
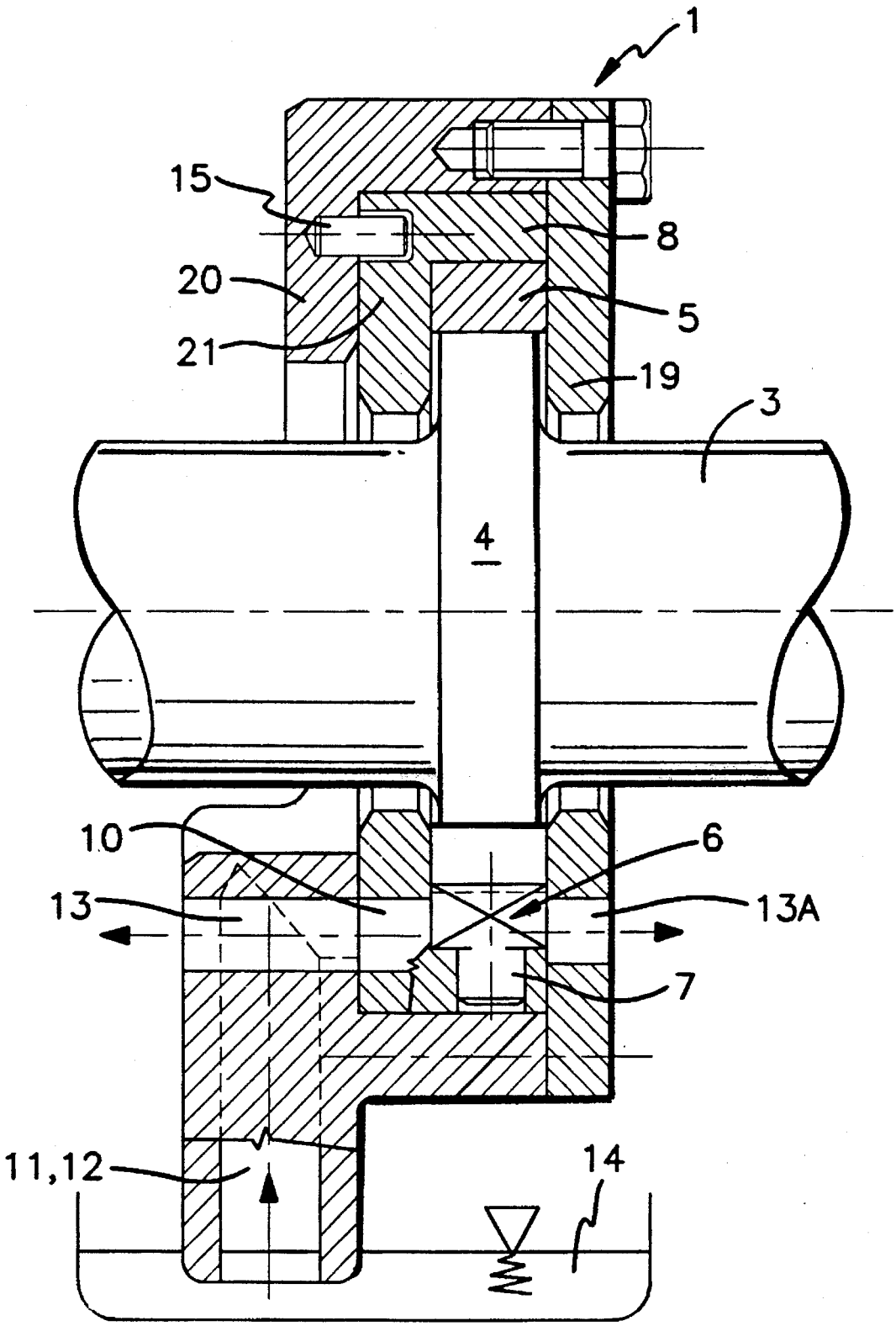
FIG. 6 shows another embodiment in longitudinal cross section.

The embodiment in FIG. 6 is similar to that shown in FIG. 3. In addition, there is a possibility to divide the outflow liquid into two streams and into two different directions. For this purpose, not only one outlet opening 13 is provided in the wall 20 but an additional outlet opening 13A is also formed in the wall 19, which is opposite to the wall 20. If the diameters of the outlet openings 13 and 13A are different, the quantities of the outflow will be different, two. With this, different liquid supplies can be realised with the same pump. With suitable arrangement of the outlet opening 13A can be secured, that the liquid will be discharged through this only in one rotational direction of the shaft 3 and with the other rotational direction, only through the first outlet opening 13. The arrangement of the openings 11 to 13 is the same as in FIG. 5.

The space requirement of the eccentric pump can further be reduced if, as it is shown in FIG. 6, the pin 15 is arranged perpendicularly to what has been shown in FIG. 1. The pin 15 is still fixed in and protruding out of the slide member 8, more precisely its flange portion 21, and the arched slot 16 is in the side wall 20. This rotation limiting arrangement functions however as it has been described with FIG. 1.

The most important advantage is apparent in that the change in rotational direction of the shaft 3 will not influence the liquid transportation of the eccentric pump at all, since switch-over between the two operational positions is controlled just by the rotation itself. It cannot be disregarded that, as a result of the invention, the eccentric pump gets applicable in drives as well, with direct mounting on the force transmitting shaft of the drive having a changing rotational direction. Since the eccentric pump as in this invention is a very small and simple unit, more than one of it can be arranged in the same drive. This is a quite important advantage when the construction costs and the duration as well as the operational security of the highly sophisticated drives are considered. It is still another advantage, that the arrangement of the communication ports of this eccentric pump is very variable, and, thus, all constructional requirement of the drives can be fulfilled.

We claim:

1. Eccentric pump with lock valve and with bidirectional rotational operation, mainly for lubricant circulation of drives comprising:

a stationary outer casing having two parallel side walls and a cylindrical inner surface between the side walls, and further having inlet and outlet openings being sealingly separated and terminating in the cylindrical inner surface, a middle shaft arranged within the casing concentrically to the cylindrical inner surface and having a cylindrical surface being eccentric to the middle shaft as well as to the cylindrical inner surface of the casing, a circular sealing ring being sealingly displaceable in respect of the eccentric surface of the shaft as well as to inner wall portions of the casing, and further having a radial slot having limiting surfaces, and a stationary pin disposed in said slot in contact with said limiting surfaces, wherein:

an inner slide member is arranged between the casing and the circular sealing ring, the slide member being sealingly but moveably attached to inner surfaces of the casing, and means to rotate the slide member between a first position and a second position, and the casing has two said inlet openings and at least one said outlet opening, and the slide member has two through bores, the first through bore is in communication with one inlet opening, the second through bore with at least one outlet opening, in the first position of the slide member, and the first through bore is in communication with at least one outlet opening, the second through bore with the other inlet opening, in the second position of the slide member, and the pin is fixed to the slide member and is sealingly separating the through bores from each other.

2. Eccentric pump as claimed in claim 1, wherein the slide member and the pin are made of one piece.

3. Eccentric pump as claimed in claim 1, wherein the slide member has a flange being perpendicular to its cylindrical surface and sealingly but moveably attached to the inner surface of a side wall of the casing, and the inlet and outlet openings of the casing are formed in this side wall and the through bores are formed in the flange of the slide member.

4. Eccentric pump as claimed in claim 3, wherein a second outlet opening is provided in the side wall which is opposite to the side wall containing the first outlet opening.

5. Eccentric pump as claimed in claim 1, wherein stopping means are provided in the slide member and the outer casing determining the first and second positions of the slide member.

6. Eccentric pump as claimed in claim 5, wherein said stopping means are formed as a pin fixed in the slide member and protruding into an arched slot of the casing, and a length of the slot is equal to a length of the rotational movement of the slide member between its two positions.

7. Eccentric pump as claimed in claim 5, wherein the slide member has a cam protruding out from the cylindrical radial surface of the slide member and engaging a recess in the casing and a length of the recess is equal to a length of the rotational movement of the slide member between its two positions.

* * * * *

UNITED STATES PATENT AND TRADEMARK OFFICE

CERTIFICATE OF CORRECTION

PATENT NO. : 5,573,388

DATED : November 12, 1996

INVENTOR(S) : Lorant TAR et al.

It is certified that error appears in the above-indentified patent and that said Letters Patent is hereby corrected as shown below:

On the title page:

In Item [75] Inventor: change the given name of the third inventor from "Iibor" to --Tibor--.

Signed and Sealed this

Fourteenth Day of January, 1997

*Attest:*

*Attesting Officer*

BRUCE LEHMAN

*Commissioner of Patents and Trademarks*